US005819835A

United States Patent [19]

Broome

[11] Patent Number: 5,819,835

[45] Date of Patent: Oct. 13, 1998

[54] ROLL-UP DIVIDER

[75] Inventor: Michael D. Broome, Greenfield, Ind.

[73] Assignee: Draper Shade & Screen Co., Inc., Spiceland, Ind.

[21] Appl. No.: 531,077

[22] Filed: Sep. 20, 1995

[51] Int. Cl.[6] ..... A47G 5/02

[52] U.S. Cl. ..... 160/243; 160/259; 160/310; 226/190

[58] Field of Search ..... 160/41, 85, 191, 160/243, 310; 226/190, 196, 88; 242/548, 615.2, 615.4

[56] References Cited

U.S. PATENT DOCUMENTS

| | | | |
|---|---|---|---|
| 2,281,022 | 4/1942 | Cavanaugh | 160/85 |
| 2,349,368 | 5/1944 | Myers | 160/85 |
| 3,186,473 | 6/1965 | Myers et al. | 160/26 |
| 3,398,779 | 8/1968 | Kuss | 160/243 |
| 3,460,602 | 8/1969 | Hugus | 160/265 |
| 3,583,465 | 6/1971 | Youngs et al. | 160/264 |
| 3,693,695 | 9/1972 | Deane | 160/243 |
| 3,704,742 | 12/1972 | Kuss | 160/243 |
| 3,747,132 | 7/1973 | Foster | 4/172.14 |
| 3,900,063 | 8/1975 | Roller | 160/310 |
| 4,084,683 | 4/1978 | Moss | 226/190 X |
| 4,244,417 | 1/1981 | Taylor | 160/243 |
| 4,298,048 | 11/1981 | Roller | 160/243 |
| 4,624,084 | 11/1986 | Esposito | 52/173 R |
| 4,800,946 | 1/1989 | Rosenoy | 160/264 |
| 4,815,515 | 3/1989 | Lee | 160/23.1 |
| 4,972,894 | 11/1990 | Machill | 160/235 |
| 4,987,942 | 1/1991 | Erikson | 160/243 |
| 4,997,022 | 3/1991 | Klein | 160/265 |
| 5,123,474 | 6/1992 | Smith | 160/310 |
| 5,307,859 | 5/1994 | Kraeutler | 160/264 |
| 5,383,510 | 1/1995 | Allen | 160/243 X |

FOREIGN PATENT DOCUMENTS

| | | | |
|---|---|---|---|
| 1267642 | 5/1968 | Germany | 160/243 |

*Primary Examiner*—Daniel P. Stodola
*Assistant Examiner*—Bruce A. Lev
*Attorney, Agent, or Firm*—Baker & Daniels

[57] ABSTRACT

A roll-up apparatus including a curtain suspended within a room to be divided or partially closed off and a roll member at the bottom edge of the curtain around which the curtain winds and unwinds. The curtain is raised by rolling the curtain up from the bottom around the roll member, and lowered by unrolling the curtain from around the roll member. Belts spaced along the width of the curtain are looped under the curtain wound roll member and windably attached to a motor driven take-up shaft. When wound around the take-up shaft, the belts are pulled upward to effect a rolling of the curtain around the roll member that raises the curtain. The belts are structured, such as by the provision of a coating material, to adhere to the material of the curtain to prevent belt slippage relative to the curtain and to thereby effect a relatively tight curtain winding. Crowned rollers which achieve a self-centering effect on the belts are also provided to cause the belts to wind about themselves on the take-up shaft.

13 Claims, 2 Drawing Sheets

ROLL-UP DIVIDER

BACKGROUND OF THE INVENTION

The present invention pertains to an apparatus for dividing or compartmentalizing a room, and, in particular, to a roll-up divider which is rolled up from the bottom during raising of the divider and unrolled from the bottom during lowering of the divider.

Roll-up dividers include a flexible curtain, suspended within a room or over a room opening such as a doorway, which can be wound up on a pipe or roll that is wrapped within the lower portions of the curtain. The pipe is supported by flexible belts, such as flat webs or ropes, looped under the pipe. When the length of each looped belt is increased, such as by unwinding one belt end portion from around a take-up shaft while holding the other belt end at a fixed height, the pipe descends under gravity and in so doing allows portions of the curtain to unwrap from the pipe to form a temporary wall. When the looped belts are shortened, the pipe is lifted and caused to roll up within the bottom portion of the curtain to effect a raising of the curtain.

Existing roll-up dividers frequently suffer from several shortcomings which diminish their utility. For example, one shortcoming results from the desirability of having the belts wrap around themselves on the take-up shaft as the curtain is raised. To achieve this stacked belt wrapping arrangement, some manufacturers provide washer-shaped elements on the take-up shaft to form spools that receive and guide the belts during their winding. However, the washer-shaped elements which define the axial ends of these spools rub against the edges of the belts and can begin to wear away and damage the belts. Moreover, the ability of the washer-shaped elements to push the belts into alignment if the belts become mistracked is limited.

Other attempts to guide belt wrapping have involved providing a guide assembly having a slot through which the belt extends, wherein the walls defining the slot serve to center the belt for its winding on the take-up shaft. As with the use of spools, this technique can lead to belt damage over time. In a design disclosed in U.S. Pat. No. 4,298,048, the slot-defining walls are equipped with rollers that rollingly engage the belt edges. Although this design may be effective to slow belt wear, it is undesirably complicated and may increase the cost of manufacture and assembly.

Another shortcoming of conventional roll-up dividers is that frequently during curtain raising the curtain rolls up rather loosely around the lower pipe. This loose wrapping, which can result from the curtain sliding along the divider belts as the belts are wound on the take-up shaft, causes a sloppy appearance for the rolled up divider curtain which is not aesthetically pleasing.

Thus, it is desirable to provide a roll-up divider which overcomes these and other shortcomings of the prior art.

SUMMARY OF THE INVENTION

The present invention provides a roll-up divider having belts which are complementarily designed with the construction of the curtain to provide a non-slip relationship therebetween. As the curtain will adhere to the belt as the belt is drawn upward during curtain raising, a tight and uniform wrapping of the curtain around the lower pipe is achieved, thereby improving the appearance of the divider when arranged in a raised condition. The roll-up divider also employs crowned rollers to guide the winding of the belts around the rotatable take-up shaft in a simple but effective manner.

The present invention provides a roll-up apparatus including a support member mounted at an overhead location and a flexible curtain suspended therefrom. The lower end portion of the curtain is movable away from the floor over which it suspended via winding around a roll member wound therein, and is lowered toward the floor by the curtain unwinding from around the roll member. The roll-up apparatus also includes at least one belt take-up member, and means connected to the take-up member for winding the curtain around the roll member as the roll member moves upwardly to thereby raise the curtain when the belt take-up member rotates in one direction and for unwinding the curtain from around the roll member as the roll member moves downwardly to thereby lower the curtain when the belt take-up member rotates in the other direction. The curtain winding and unwinding means includes at least one belt windable on and unwindable from the belt take-up member. In one form of the invention, the roll-up apparatus includes a belt having a material construction which is designed complementarily with the curtain material construction to provide a non-slipping engagement therebetween that produces a tight winding of the curtain around the roll member. In another form of the invention, the roll-up apparatus includes a guide means for guiding the belt to wind upon itself around the belt take-up member, and the guide means includes at least one crowned roller.

One advantage of the present invention is that the roll-up divider belts are guided during winding without their edges engaging laterally positioned walls or members, thereby limiting damage to the belts.

Another advantage of the present invention is that the guides for aligning the belts on the take-up shaft have a simple construction.

Another advantage of the present invention is that the belts are adapted to adhere to the curtain material in such a manner that a tight, uniform and aesthetically pleasing curtain winding around the lower pipe of the divider is achieved.

BRIEF DESCRIPTION OF THE DRAWINGS

The above mentioned and other advantages and objects of this invention, and the manner of attaining them, will become more apparent and the invention itself will be better understood by reference to the following description of an embodiment of the invention taken in conjunction with the accompanying drawings, wherein.

Figure 2:
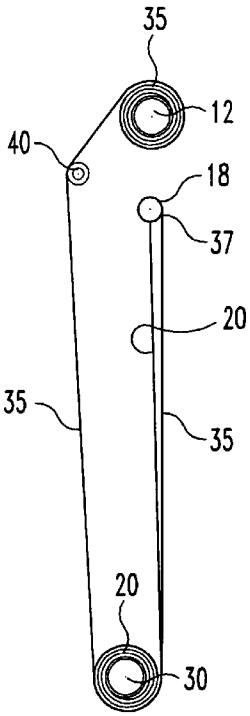
FIG. 2 is a cross-sectional view taken along line 2—2 of selected portions of the roll-up divider of FIG. 1 after being operated to partially raise the curtain.

Corresponding reference characters indicate corresponding parts throughout the several views. Although the drawings represent an embodiment of the invention, the drawings are not necessarily to scale and certain features may be exaggerated or omitted in order to better illustrate and explain the present invention.

DESCRIPTION OF THE PREFERRED EMBODIMENT

Figure 1:
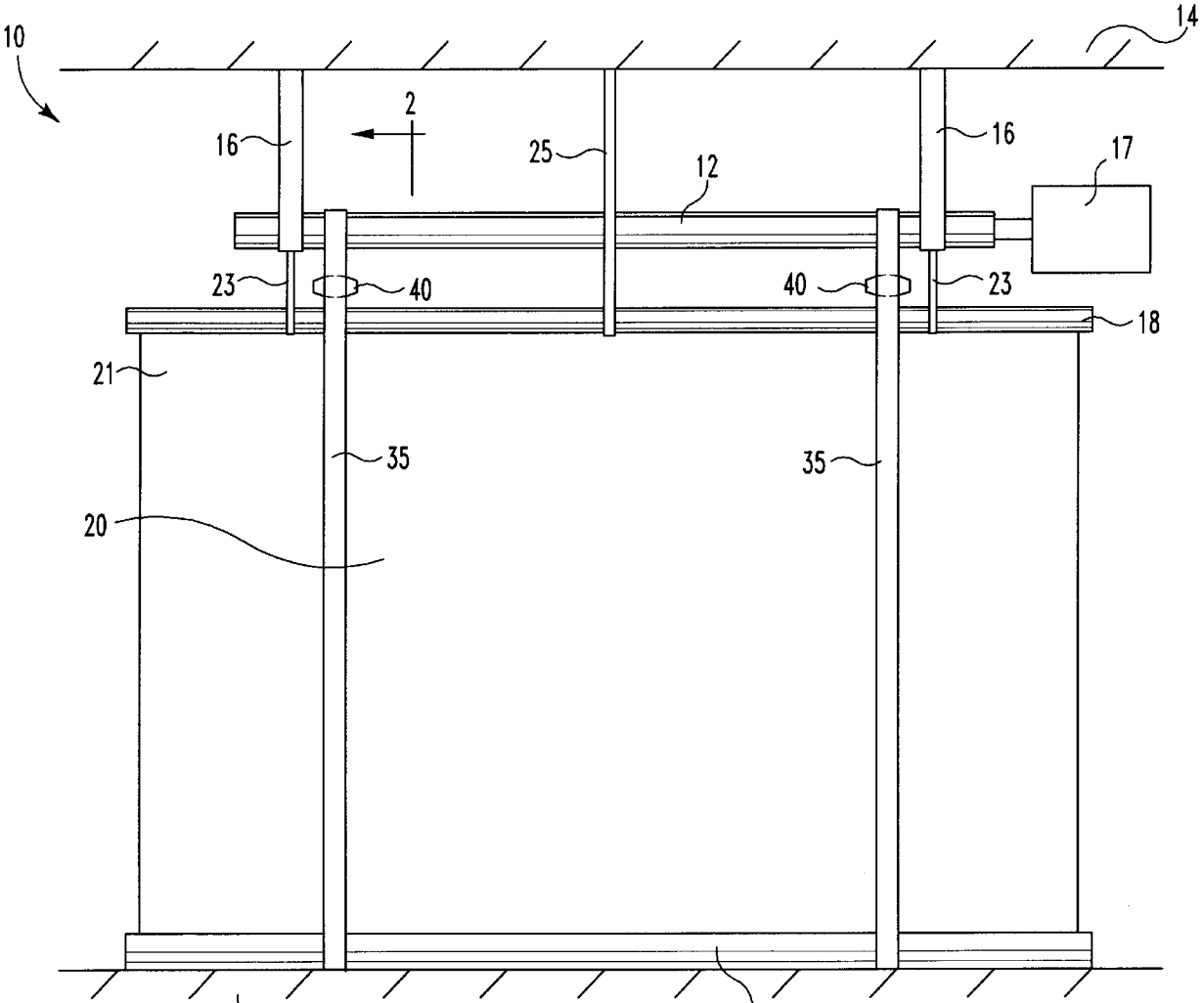
FIG. 1 is a diagrammatic front view of an installed embodiment of the roll-up divider of the present invention.

Referring now to the front elevational view of FIG. 1, there is diagrammatically shown a roll-up divider configured according to the principles of the present invention. Certain structural portions of the roll-up divider which may be of any suitable type known in the art have been abstractly shown or omitted in the interest of clarity of illustration, and further because the construction of such portions are not essential to an understanding of the present invention. Furthermore, although the roll-up divider is shown and described herein with reference to its use as a gymnasium divider, this usage is merely illustrative of the present invention and is not intended to be limiting. The roll-up divider of the invention can be advantageously employed in other situations, for example in different types of rooms which require temporary compartmentalization.

The roll-up gymnasium divider is generally designated 10 and includes a rotatable, cylindrical take-up shaft or pipe 12 mounted overhead within a gymnasium which on occasion is required to be compartmentalized or divided into two, smaller areas. A building structural member, such as a ceiling beam exposed within the gym, is indicated generally at 14, and abstractly shown mounting brackets 16 suspend pipe 12 from ceiling beam 14. Mounting brackets 16 include suitable bearings to allow pipe 12 to rotate in either direction around its axis. For example, pairs of ball bearing mounted wheels can be positioned both above and below pipe 12 within each mounting bracket 16 to provide adequate rolling support for pipe 12. Although only two mounting brackets 16 located proximate the opposite axial ends of pipe 12 are shown, as is known in the art the number of mounting brackets 16 is variable dependent on an assortment of factors, including the length and height of the curtain which descends to form the temporary wall. To provide adequate pipe support, mounting brackets 16 are preferably located adjacent each belt 35 used to roll up or down the gymnasium curtain as described below.

A reversible motor, abstractly shown at 17, is mounted to the gymnasium ceiling in a suitable but not shown fashion and is operationally attached to pipe 12. When energized, and depending on the motor control selected, motor 17 rotates pipe 12 about its axis to cause belts 35 either to wind around pipe 12 to effect a curtain raising or to unwind from pipe 12 to effect a curtain lowering.

Positioned at a height below pipe 12 is a curtain support shaft 18 upon which an upper end portion 21 of curtain 20 is wrapped around and secured. Support shaft 18 is suspended by chains shown abstractly at 23 which drop down from the underside of mounting brackets 16 and loop around shaft 18. To prevent shaft sagging, additional chains such as shown at 25 can suspend support shaft 18 from ceiling beam 14.

The curtain 20 suspended from support shaft 18 is tall enough to extend to gym floor 28 and is designed to wrap around and unwrap from a cylindrical, lower pipe 30. The bottom edge of curtain 20 is fastened to lower pipe 30 in a suitable fashion, such as by rolling curtain 20 around pipe 30 and pinning the curtain in place by use of a metallic strip (not shown) secured to the pipe with screws. Alternate attachment configurations are within the scope of the invention. Curtain 20 is made from vinyl clad polyester or other suitable material, and although generally shown as a solid sheet may be provided with netting, for example at a curtain height closer to upper end 21 than gym floor 28, to allow ventilation between the divided room areas.

Referring now to FIG. 2, which is a cross-sectional view of selected portions of roll-up divider 10 taken along line 2—2 of FIG. 1, roll-up divider 10 is shown in a partially rolled up position as it is raised from the lowered arrangement illustrated in FIG. 1 to a raised arrangement generally out of the way of gymnasium users. The assembly for converting rotation of take-up shaft 12 into movement and rotation of lower pipe 30 includes a plurality of belts 35 windable around pipe 12. In this embodiment, belts 35 are shown as a flat web in construction, but other belt shapes also may be employed. While two belts 35 are shown in FIG. 1, as is known in the art additional belts, spaced at even intervals typically within the range of about ten feet to about twenty feet, may be provided for longer length curtains to support the additional curtain weight and prevent sagging of lower pipe 30.

One end portion of each belt 35 is fastened or secured to upper pipe 12, and about this end portion the remainder of the belt 35 overlaps in stacked relationship during the raising of curtain 20. The belt distal ends 37 are secured to curtain support shaft 18 as shown in FIG. 2. Without compromising the general function of the belts, belt ends 37 could alternatively be secured to other fixed structures, such as the pipe mounting brackets 16 or ceiling beam 14, within the scope of the invention.

Belts 35 are complementarily designed with curtain 20 to provide a non-slipping engagement therebetween that allows curtain 20 to be rolled up around pipe 30 in a relatively tight and uniform fashion. For use with the vinyl composition of the exterior of curtain 20, belts 35 are made of a strip of a strong material, such as nylon or polyester, with a polyurethane coating for direct contact with curtain 20. The polyurethane coating grips to the vinyl material so as to limit slippage of the curtain relative to belts 35. While this coating material is presently preferred, those of skill in the art will appreciate that other coating compositions which adhere to vinyl could be substituted within the scope of the invention, and further that for other curtain materials suitable non-slip belt constructions or coatings may be employed. In addition, the vertically extending strips of the curtain expected to contact belts 35 could be treated with a coating to adhesively cooperate with the composition of the belts.

One product found suitable for use as belts 35 is a BioThane® polyurethane coated belting product which is about 4.0 inches wide and between about 0.095–0.105 inches thick, and is available from BioPlastics of North Ridgeville, Ohio as 4" Standard Black 101.

To guide belts 35 such that each belt 35 wraps or winds about itself in stacked relationship on upper pipe 12, rotatable guide rollers 40 over which belts 35 are rollingly routed are advantageously utilized. As shown in FIG. 2, guide rollers 40 are laterally offset from upper and lower pipes 12, 30. Guide rollers 40 are shown positioned at a height below take-up pipe 12, but may be alternately positioned.

Figure 3:
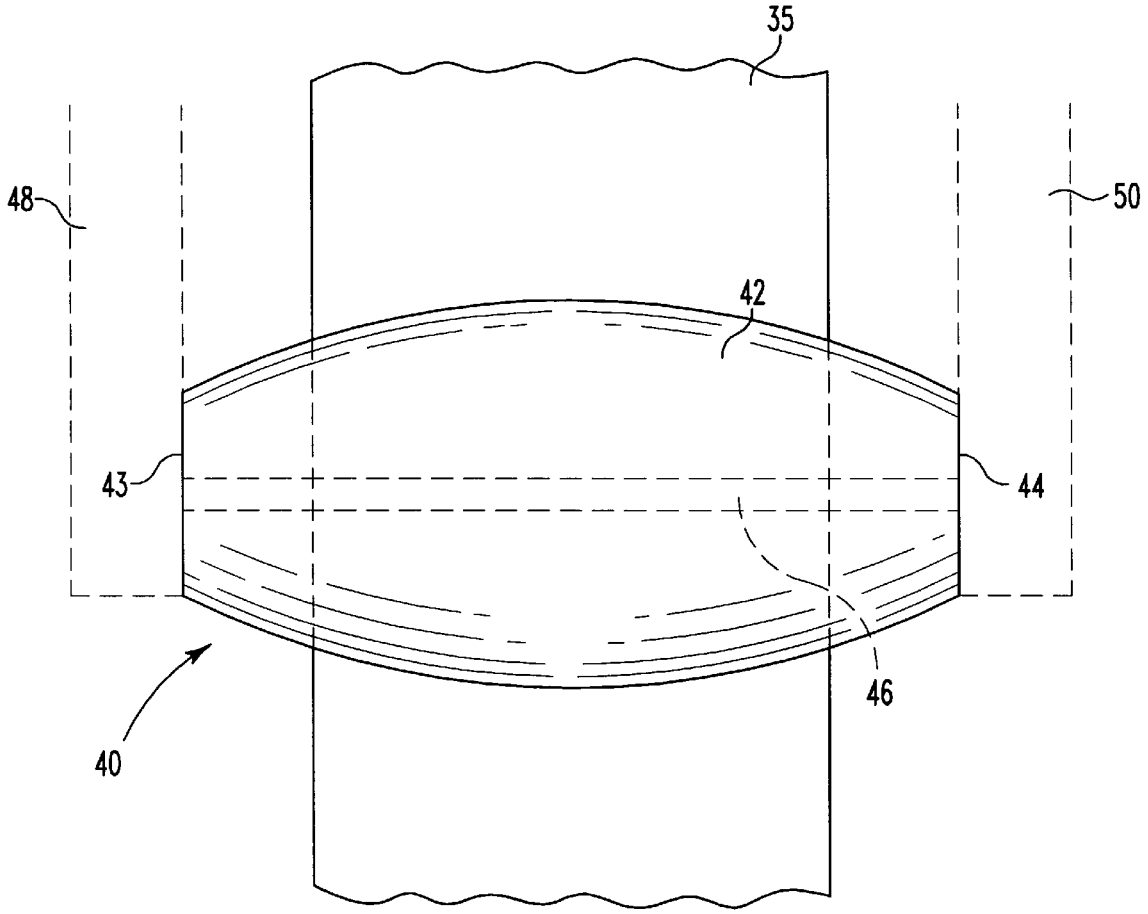
FIG. 3 is an enlarged rear view of a crowned guide roller engaging a belt, wherein the roller mounting bracket members are abstractly shown in dashed lines.

Referring now to FIG. 3, there is shown an enlarged, rear elevational view of a guide roller 40 centerably engaging a portion of a passing roll-up belt 35. Guide roller 40 includes a crowned body section 42 which terminates at opposite ends 43, 44. Guide roller 40 may be made from any of a variety of hard materials including hard maple or other hard woods, nylon or another durable hard plastic, or materials such as steel, aluminum or brass. For use with a four inch wide belt 35, a suitable crowned body section 42 has a length of approximately six inches, and a radius of curvature of the convex bowing of body section 42 of between about 3 inches and about 96 inches, and preferably between about 36 inches and about 48 inches. For different sizes of guide rollers, different ranges of radius of curvature can naturally be employed. Axial bore 46 can receive an axle member secured to bracket members 48, 50 so as to allow roller 40 to rotate relative to its mounting during operation. Bracket members 48, 50 may be vertically extending portions of angle irons interconnected into a suitable framework used to support mounting brackets 16. However, bracket members 48, 50 are abstractly shown in dashed lines in FIG. 3 as their overall construction is not material to the present invention as they perform no centering function and can be replaced with other types of framing which serves to mount guide rollers 40 in a desired relationship relative to pipes 12, 30.

The structure of roll-up divider 10 will be further understood in view of the following explanation of its operation. When divider 10 is arranged in its extended position shown in FIG. 1, the raising of curtain 20 begins by activating motor 17 to rotate take-up shaft 12 in a clockwise direction from the perspective of a FIG. 2 viewer. As take-up shaft 12 rotates, belts 35 are caused to wind or wrap around shaft 12. Crowned guide rollers 40 maintain belts 35 in a proper alignment such that the belts wrap around themselves in stacked relationship on shaft 12 as shown in FIG. 2. In particular, the crowned configuration of guide rollers 40 has been found to provide a self-centering effect for belts 35 that counteracts any transverse wandering of the belts. As a result of their being self-centering along the axial lengths of crowned rollers 40, belts 35 stay in spaced apart relationship with frame members 48, 50 to prevent damaging wear of the belt edges.

As belts 35 wind up around shaft 12 and the length of the looped belts decreases, bottom pipe 30 is lifted upward. Due to the adherence between the polyurethane coating of belts 35 and the vinyl curtain material, the portion of the curtain engaging belts 35 is pulled upward and wraps around rotating pipe 30 in a uniformly tight manner as shown in FIG. 2.

To lower curtain 20, motor 17 is reversed to rotate upper pipe 12 in a counter-clockwise direction, causing belts 35 to unwind therefrom, which in turn results in lower pipe 30 descending. While pipe 30 descends and rotates, curtain 20 unwinds therefrom to effectively form the temporary wall.

While this invention has been shown as having a single design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A roll-up apparatus for use in a room including a floor, comprising:

a support member mounted at an overhead location;

a flexible curtain suspended from said support member, said flexible curtain including a lower end portion movable toward and away from the room floor;

a roll member disposed at said curtain lower end portion and around which said curtain is windable and unwindable;

at least one belt take-up member rotatable in first and second directions; and means, connected to said at least one belt take-up member, for winding said curtain around said roll member as said roll member moves upwardly to thereby raise said curtain when said at least one belt take-up member rotates in said first direction and for unwinding said curtain from around said roll member as said roll member moves downwardly to thereby lower said curtain when said at least one belt take-up member rotates in said second direction;

wherein said curtain winding and unwinding means comprises at least one belt windable on and unwindable from said at least one belt take-up member, and wherein said at least one belt comprises a material construction complementarily structured with a material construction of said curtain to provide a directly contacting, non-slipping engagement between said at least one belt and said curtain, whereby said curtain tightly winds around said roll member;

wherein said material construction of at least a portion of said at least one belt which contacts said curtain comprises a polyurethane coating adherent to said curtain, and wherein said material construction of said curtain contacted by said belt coating comprises vinyl.

2. The roll-up apparatus of claim 1 further comprising means for guiding winding of said at least one belt on said at least one belt take-up member, said guiding means comprising at least one crowned roller structured and arranged to produce a self-centering effect for said at least one belt on said crown roller whereby said at least one belt winds upon itself around said at least one belt take-up member.

3. The roll-up apparatus of claim 2 wherein said at least one belt comprises a flat web configuration.

4. The roll-up apparatus of claim 1 wherein said at least one belt comprises a plurality of belts.

5. A roll-up apparatus for use in a room including a floor, comprising:

a support member mounted at an overhead location;

a flexible curtain suspended from said support member, said flexible curtain including a lower end portion movable toward and away from the room floor;

a roll member disposed at said curtain lower end portion and around which said curtain is windable and unwindable;

at least one belt take-up member rotatable in first and second directions;

means, connected to said at least one belt take-up member, for winding said curtain around said roll member as said roll member moves upwardly to thereby raise said curtain when said at least one belt take-up member rotates in said first direction and for unwinding said curtain from around said roll member as said roll member moves downwardly to thereby lower said curtain when said at least one belt take-up member rotates in said second direction, wherein said curtain winding and unwinding means comprises at least one belt windable on and unwindable from said at least one belt take-up member; and guide means for guiding said at least one belt to wind upon itself around said at least one belt take-up member, said guide means comprising at least one crowned roller.

6. The roll-up apparatus of claim 5 wherein said crowned roller comprises a convexly bowed body, and wherein a radius of curvature of the bowing of said body comprises less than about 96 inches.

7. The roll-up apparatus of claim 5 wherein said crowned roller comprises a convexly bowed body, and wherein a radius of curvature of the bowing of said body comprises between about 36 inches and about 48 inches.

8. The roll-up apparatus of claim 5 said at least one belt comprises a flat web configuration.

9. The roll-up apparatus of claim 8 wherein said at least one belt comprises a coating which cooperates with said curtain to prevent slippage between said at least one belt and said curtain.

10. The roll-up apparatus of claim 5 wherein said at least one belt comprises a plurality of belts, and wherein said guide means comprises at least one crowned roller for each of said plurality of belts.

11. A roll-up divider for compartmentalizing a room including a floor, comprising:

a support member mounted at an overhead location;

a flexible curtain suspended from said support member, said flexible curtain including a lower end portion movable toward and away from the room floor;

a roll member disposed at said curtain lower end portion and around which said curtain is windable and unwindable;

at least one belt take-up member rotatable in first and second directions;

means, connected to said at least one belt take-up member, for winding said curtain around said roll member as said roll member moves upwardly to thereby raise said curtain when said at least one belt take-up member rotates in said first direction and for unwinding said curtain from around said roll member as said roll member moves downwardly to thereby lower said curtain when said at least one belt take-up member rotates in said second direction;

wherein said curtain winding and unwinding means comprises at least one belt windable on and unwindable from said at least one belt take-up member, and wherein said at least one belt comprises a material construction complementarily structured with a material construction of said curtain to provide a directly contacting non-slipping engagement between said at least one belt and said curtain, whereby said curtain tightly winds around said roll member; and guide means for centering said at least one belt to wind upon itself around said at least one belt take-up member, said guide means comprising at least one crowned roller positioned to rollingly engage said belt between said take-up member and said curtain lower end portion.

12. The roll-up divider of claim 11 wherein said at least one belt comprises a plurality of belts, and wherein said guide means comprises at least one crowned roller for each of said plurality of belts.

13. The roll-up divider of claim 11 wherein said material construction of at least a portion of said at least one belt which contacts said curtain comprises a polyurethane coating adherent to said curtain, and wherein said material construction of said curtain contacted by said belt coating comprises vinyl.

* * * * *

UNITED STATES PATENT AND TRADEMARK OFFICE

CERTIFICATE OF CORRECTION

PATENT NO. : 5,819,835

DATED : October 13, 1998

INVENTOR(S) : Michael D. Broome

It is certified that error appears in the above-indentified patent and that said Letters Patent is hereby corrected as shown below:

Claim 8, column 6, line 62, after "claim 5", insert --wherein--.

Claim 11, column 8, line 4, after "contacting", insert --,--.

Signed and Sealed this

Thirteenth Day of April, 1999

*Attest:*

Q. TODD DICKINSON

*Attesting Officer*

*Acting Commissioner of Patents and Trademarks*